US008518478B2

(12) United States Patent
Chung et al.

(10) Patent No.: US 8,518,478 B2
(45) Date of Patent: Aug. 27, 2013

(54) CONDUCTIVE FIBERS AND A METHOD OF MANUFACTURING THE SAME

(75) Inventors: Kwang Choon Chung, Gyeonggi-do (KR); Hyun Nam Cho, Gyeonggi-do (KR); Jae Ho Baek, Gyeonggi-do (KR); Ji Hoon Yoo, Gyeonggi-do (KR)

(73) Assignee: Inktec Co., Ltd., Kyungki-do (KR)

( * ) Notice: Subject to any disclaimer, the term of this patent is extended or adjusted under 35 U.S.C. 154(b) by 587 days.

(21) Appl. No.: 12/449,693

(22) PCT Filed: Feb. 22, 2008

(86) PCT No.: PCT/KR2008/001064

§ 371 (c)(1),
(2), (4) Date: Sep. 21, 2010

(87) PCT Pub. No.: WO2008/103013

PCT Pub. Date: Aug. 28, 2008

(65) Prior Publication Data

US 2011/0003153 A1 Jan. 6, 2011

(30) Foreign Application Priority Data

Feb. 22, 2007 (KR) ..... 10-2007-0017715

(51) Int. Cl.
*B05D 3/02* (2006.01)

(52) U.S. Cl.
USPC ..... 427/229

(58) Field of Classification Search
USPC ..... 427/229
See application file for complete search history.

(56) References Cited

U.S. PATENT DOCUMENTS

| | | | | |
|---|---|---|---|---|
| 3,958,066 | A | 5/1976 | Imamura et al. | |
| 4,364,993 | A * | 12/1982 | Edelman et al. | 428/298.7 |
| 4,542,214 | A | 9/1985 | Bechara | |
| 4,652,465 | A * | 3/1987 | Koto et al. | 427/216 |
| 4,670,189 | A | 6/1987 | Tomibe et al. | |
| 6,357,542 | B1 * | 3/2002 | Sako | 180/68.5 |
| 6,387,542 | B1 * | 5/2002 | Kozlov et al. | 428/673 |
| 2001/0055681 | A1 * | 12/2001 | Phillips et al. | 428/364 |
| 2003/0039458 | A1 * | 2/2003 | Miller et al. | 385/128 |

FOREIGN PATENT DOCUMENTS

| | | |
|---|---|---|
| JP | 1-207473 | 8/1989 |
| JP | 1-260058 | 10/1989 |
| JP | 2001-200470 | 7/2001 |
| KR | 2003-0022234 | 3/2003 |
| KR | 2006-0011083 | 2/2006 |

OTHER PUBLICATIONS

G. Ruschau et al., "Resistivities of conductive composites", *J. Appl. Phys.* 72, (3), Aug. 1, 1992, p. 953-959.

* cited by examiner

*Primary Examiner* — Michael Cleveland
*Assistant Examiner* — Robert Vetere
(74) *Attorney, Agent, or Firm* — Clark & Brody

(57) ABSTRACT

The present invention relates to a method of manufacturing conductive fibers, more precisely a method of manufacturing conductive fibers comprising the steps of coating silver complex compound coating solution on non-conductive fibers to coat the fibers with silver complex compound; heating the fibers to form a silver coating layer; and forming an antioxidant layer thereon, and conductive fibers prepared by the same.

The method of manufacturing conductive fibers of the present invention not only is simple and easy but also requires low production costs. So, the conductive fibers prepared by the method of the present invention are not only excellent in conductivity but also excellent in other mechanical properties such as adhesive strength of the conductive layer, fiber strength and softness, etc.

17 Claims, 1 Drawing Sheet

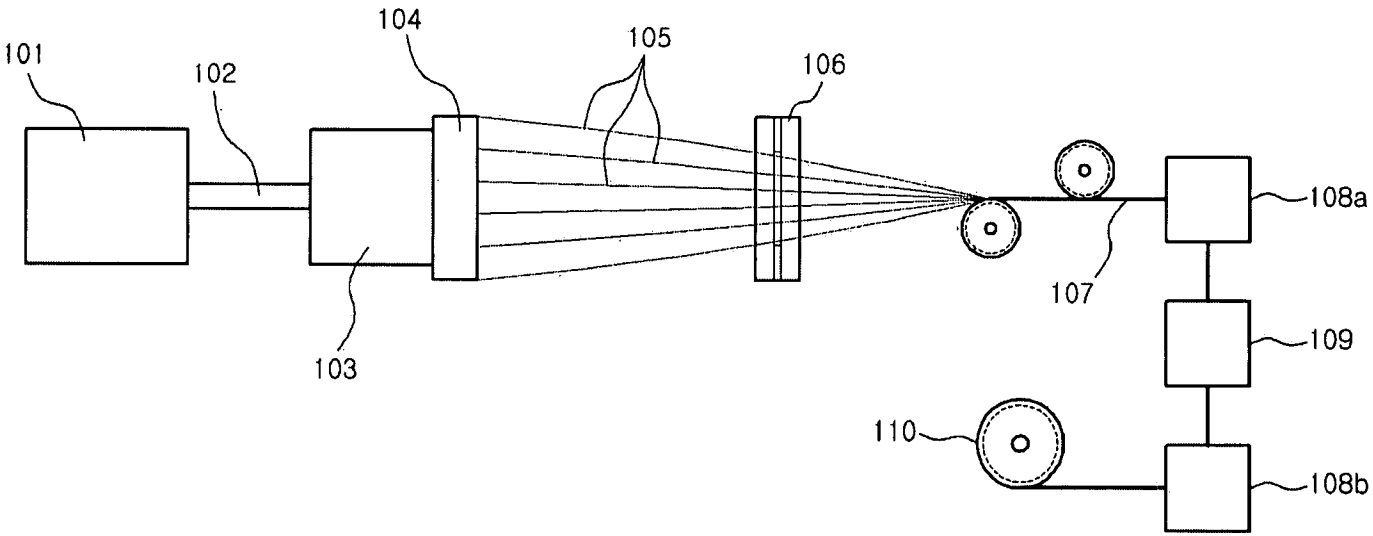
101
102
103
104
105
106
107
108a
109
108b
110

CONDUCTIVE FIBERS AND A METHOD OF MANUFACTURING THE SAME

TECHNICAL FIELD

The present invention relates to conductive fibers and a method of manufacturing the same, more precisely a method of manufacturing conductive fibers by coating non-conductive fibers with a special silver complex compound.

BACKGROUND ART

Recently, high performance, miniaturization and lightness of electronic equipment have been fast accomplished along with the development of semiconductor integrated circuit and surface mounting technology for loading small sized chip in the whole industrial field. And, conductive fibers were developed to prevent static electricity of electronic equipment and parts, to absorb microwave, to shield electromagnetic wave, to produce low weight electronic parts and to secure reliable performance.

The conventional conductive fibers are mostly metal fibers such as nickel, copper, stainless steel, aluminum, tin, zinc, antimony and titanium or metal coated fibers produced by coating non-conductive glass fibers or carbon fibers with such metals as nickel, gold, silver, copper and titanium via plating or deposition or sputtering. Korean Patent Publication No. 2003-0022234 and Japanese Patent No. 2001-200470 describe a method of manufacturing conductive fibers, in which a metal seed layer is coated on fibers by sputtering, followed by electroless plating. However, the method described therein has a problem of conductive layer separation because of poor adhesion of the seed layer.

Unlike the method for giving conductivity to fibers by coating inorganic fibers such as metal, glass, carbon and metal oxide with metals, the method for giving conductivity to plastic fibers is characterized by dispersing conductive fillers such as conductive spheres, needle-shaped whiskers and plate type flakes and spinning thereof to make the fillers contact or be close to each other in order to apply electricity effectively (Journal of Applied Physics, 72, 1992). At this time, the conductive filler is selected from the group consisting of metals such as iron, nickel, copper and aluminum; conductive carbon-based materials such as black lead, carbon nano-tube (CNT), carbon fiber and graphite; and a mixture thereof. However, this method has disadvantages of unsatisfactory stability resulted from coagulation or precipitation of the filler included in spinning solution and poor mechanical properties including strength and softness of fibers resulted from high volume ratio of the conductive filler required for giving enough conductivity.

DISCLOSURE

Technical Problem

The conventional method of manufacturing conductive fibers based on the prior art requires high-priced equipment with increasing production costs and has disadvantage of conductive layer separation or decrease of physical properties of fibers. So, it is the object of the present invention to provide a method of manufacturing conductive fibers which is capable of providing excellent conductivity and other mechanical properties and low production costs.

In general, sizing (surface treatment of fibers), a sort of coating to increase strength and smoothness of fibers, is necessary before weaving. According to the present invention, once fibers are coated with the silver complex compound coating solution of the present invention and heat-treated thereafter, the fiber surface is coated with very fine silver particles, resulting in smoothness, conductivity and sizing effect as well.

The present inventors achieved this invention by confirming that the above object can be achieved by coating non-conductive fibers with silver complex compound coating solution and heating the same and then forming a silver coating layer and an anti-oxidant layer.

Technical Solution

The present invention relates to conductive fibers and a method of manufacturing the same, more precisely, a method of manufacturing conductive fibers by coating non-conductive fibers with silver complex compound using silver complex compound coating solution and heating the same to form a silver coating layer and an anti-oxidant layer as well and conductive fibers produced by the method. Hereinafter, the present invention is described in detail.

Unless stated otherwise, the technical terms and scientific terms used herein are understood as conventional meanings known to those in the art.

Explanations on technical compositions and functions same to the prior art do not repeat herein.

The method of manufacturing conductive fibers of the present invention is characteristically composed of the following steps.

(i) preparing silver complex compound coated fibers by coating a strand or a bundle of fiber with silver complex compound coating solution;

(ii) preparing fibers having a silver coating layer by heating the silver complex compound coated fibers; and (iii) forming an anti-oxidant layer on the silver coating layer.

The method of manufacturing conductive fibers of the present invention can additionally include the step of forming a metal coating layer on the silver coating layer using copper, nickel and gold via electro-plating or electroless plating, after step (ii).

The method of manufacturing conductive fibers of the present invention can also include the step of solution spinning or melt spinning after cutting the prepared conductive fibers and mixing them with fiber spinning solution, after step (iii).

Step (i):

Step (i) is a step wherein a strand or a bundle of fiber is coated with silver complex compound coating solution. Precisely, fibers melted at high temperature are passed through bushing containing a plurality of orifices, cooled down with air and water, and spun. Or fibrous materials are dissolved in solvent, cooled down in the air and spun. Or strands prepared by spinning in fiber-insoluble solvent are coated with silver complex compound by applying silver complex compound coating solution thereon and then plaited to give fibers coated with silver complex compound.

Herein, it is also possible to plait fiber strands first, resulting in fiber bundles, and then apply silver complex compound coating solution thereon to give fibers coated with silver complex compound.

Sizing can be accomplished by the silver complex compound itself, but to increase sizing effect, fibers can be coated additionally with a sizing agent. Fibers can be either coated with a sizing agent first and then with silver complex compound or coated with silver complex compound first and then with a sizing agent. Or the sizing agent and the silver complex compound can be used at the same time for coating. To increase adhesive strength with fibers for the coating process, a binder resin and/or an adhesion enhancer can be additionally added.

Conductive fibers can be prepared by the above method. Fibers already prepared, that are fiber bundles already being through the process of bushing and spinning and treated with a sizing agent, are unwoven again into fiber strands and then the fiber strands can be coated with silver complex compound alone or silver complex compound coating solution containing a binder resin and/or an adhesion enhancer, or coated with a binder resin and/or an adhesion enhancer first and dried and then coated with silver complex compound, which are plaited to give fibers coated with silver complex compound.

The binder resin herein can be selected from the group consisting of phenol modified alkyd resin, epoxy modified alkyd resin, vinyl modified alkyd resin, silicon modified alkyd resin, acryl melamine resin, polyisocyanate resin, acryl urethane resin, urea resin, melamine resin, guanamine resin, amino alkyd resin, epoxy resin, epoxy ester resin and unsaturated polyester resin, etc. The adhesion enhancer herein can be selected from the group consisting of triethoxysilane, 3-aminopropyltrimethoxysilane, 3-aminopropylethoxysilane, vinyltrimethoxysilane and vinyltriethoxysilane, etc.

To coat the surface of fibers more smoothly and evenly, a sizing agent can be used before and after coating with silver complex compound or simultaneously, and at this time, the sizing agent comprises a non-ionic surfactant, an adhesion enhancer and a binder resin, etc. The non-ionic surfactant herein can be selected from the group consisting of alkylene amines such as triethyleneglycoldiamine, polyoxypropylenediamine, polyoxymethyl-1,2-ethanediyl, hydro-2-aminomethyl-ethoxy-ether and 2-ethylhydroxymethyl-1,3-propanediol; octylphenolethoxylate; nonylphenolethoxylate; and copolymer of ethyleneoxide and propyleneoxide. The adhesion enhancer herein can be selected from the group consisting of silane compounds such as triethoxysilane, 3-aminopropyltrimethoxyilane, 3-aminopropylethoxysilane, vinyltrimethoxysilane and vinyltriethoxysilane, etc. The binder resin herein can be selected from the group consisting of acryl, urethane, polyester and epoxy resins, but not always limited thereto.

The fibers of the present invention can be selected from the group consisting of polymer fibers such as polyethyleneterephtalate, polybutyleneterephtalate, polyethylenenaphthalate, nylon, polyacrylonitrile, styrene/acryl copolymer, styrene/butadiene copolymer, styrene/isoprene copolymer, polycarbonate, polyurethane, polyethersulfon, polypropylene, polyvinylalcohol and cellulose; and inorganic fibers such as carbon, boron and glass, but not always limited thereto, and any fibers meet the criteria of the invention can be used.

The silver complex compound of the present invention is prepared by reacting the silver compound represented by formula 1, and one or more compounds selected from the ammonium carbamate based compound represented by formula 2, the ammonium carbonate based compound represented by formula 3 and the ammonim bicarbonate based compound represented by formula 4 and the mixture thereof.

[Formula 1]

$Ag_nX$

[Formula 2]

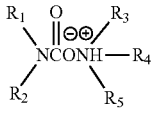

-continued

[Formula 3]

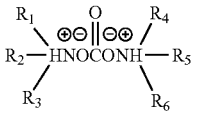

[Formula 4]

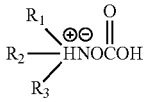

[Wherein,

X is a substituent selected from the group consisting of oxygen, sulfur, halogen, cyano, cyanate, carbonate, nitrate, nitrite, sulfate, phosphate, thiocyanate, chlorate, perchlorate, tetrafluoroborate, acetylacetonate, carboxylate and their derivatives, n is an integer of 1-4, $R_1$-$R_6$ are independently H, hydroxyl group, $C_1$-$C_{30}$ alkoxy group, $C_1$-$C_{30}$ aliphatic or cycloaliphatic alkyl group or $C_6$-$C_{20}$ aryl or aralkyl group, functional group-substituted $C_1$-$C_{30}$ alkyl and aryl group, heterocyclic compound and polymer and their derivatives. When $R_1$-$R_6$ are functional group-substituted or non-substituted alkyl group or aralkyl group, hetero atom selected from the group consisting N, S and O can be included in carbon chain. And $R_1$ and $R_2$, or $R_4$ and $R_5$ can form a ring by being connected via alkylene containing hetero atom or not.]

The compound of formula 1 is exemplified by silver oxide, silver thiocyanate, silver sulfide, silver chloride, silver cyanide, silver cyanate, silver carbonate, silver nitrate, silver nitrite, silver sulfate, silver phosphate, silver perchlorate, silver tetrafluoroborate, silver acetylactonate, silver acetate, silver lactate, silver oxalate and derivatives thereof, but not always limited thereto.

$R_1$-$R_6$ can be selected from the group consisting of hydrogen, methyl, ethyl, propyl, isopropyl, butyl, isobutyl, amyl, hexyl, ethylhexyl, heptyl, octyl, isooctyl, nonyl, decyl, dodecyl, hexadecyl, octadecyl, docodecyl, cyclopropyl, cyclopentyl, cyclohexyl, allyl, hydroxy, methoxy, hydroxyethyl, methoxyethyl, 2-hydroxy propyl, methoxypropyl, cyanoethyl, ethoxy, butoxy, hexyloxy, methoxyethoxyethyl, methoxyethoxyethoxyethyl, hexamethyleneimine, morpholine, piperidine, piperazine, ethylenediamine, propylenediamine, hexamethylenediamine, triethylenediamine, pyrrole, imidazole, pyridine, carboxymethyl, trimethoxysilylpropyl, triethoxysilylpropyl, phenyl, methoxyphenyl, cyanophenyl, phenoxy, tolyl, benzyl and its derivatives, and polymer such as polyallylamine or polyethyleneimine and derivatives thereof, but not always limited thereto.

The ammonium carbamate based compound represented by formula 2 is one or more compounds selected from the group consisting of ammonium carbamate, ethylammonium ethylcarbamate, isopropylammonium isopropylcarbamate, n-butylammonium n-butylcarbamate, isobutylammonium isobutylcarbamate, t-butylammonium t-butylcarbamate, 2-ethylhexylammonium 2-ethylhexylcarbamate, octadecylammonium octadecylcarbamate, 2-methoxyethylammonium 2-methoxyethylcarbamate, 2-cyanoethylammonium 2-cyanoethylcarbamate, dibutylammonium dibutylcarbamate, dioctadecylammonium dioctadecylcarbamate, methyldecylammonium methyldecylcarbamate, hexamethyleneimineammonium hexamethyleneiminecarbamate, morpholinium morpholinecarbamate, pyridinium ethylhexylcarbamate, triethylenediaminum isopropylbicarbamate, benzylammonium benzylcarbamate, triethoxysilylpropylammonium triethoxysilylpropylcarbamate and derivatives thereof. The ammonium carbonate based compound represented by formula 3 is one or more compounds selected from the group consisting of ammonium carbonate, ethylammonium ethylcarbonate, isopropylammonium isopropylcarbonate, n-butylammonium n-butylcarbonate, isobutylammonium isobutylcarbonate, t-butylammonium t-butylcarbonate, 2-ethylhexylammonium 2-ethylhexylcarbonate, 2-methoxyethylammonium 2-methoxyethylcarbonate, 2-cyanoethylammonium 2-cyanoethylcarbonate, octadecylammonium octadecylcarbonate, dibutylammonium dibutylcarbonate, dioctadecylammonium dioctadecylcarbonate, methyldecylammonium methyldecylcarbonate, hexamethyleneimineammonium hexamethyleneiminecarbonate, morpholineammonium morpholinecarbonate, benzylammonium benzylcarbonate, triethoxysilylpropylammonium triethoxysilylpropylcarbonate, triethylenediaminum isopropylcarbonate and derivatives thereof. The ammonium bicarbonate based compound represented by formula 4 is one or more compounds selected from the group consisting of ammonium bicarbonate, isopropylammonium bicarbonate, t-butylammonium bicarbonate, 2-ethylhexylammonium bicarbonate, 2-methoxyethylammonium bicarbonate, 2-cyanoethylammonium bicarbonate, dioctadecylammonium bicarbonate, pyridinium bicarbonate, triethylenediaminum bicarbonate and derivatives thereof.

The kinds of the above ammonium carbamate based, ammonium carbonate based or ammonium bicarbonate based compound and methods for preparing thereof are not limited. For example, U.S. Pat. No. 4,542,214 (Sep. 17, 1985) describes that the ammonium carbamate compound can be prepared from the first amine, the second amine, the third amine or a mixture of at least one of those and carbon dioxide. According to this description, the ammonium carbonate compound can be prepared by additionally adding 0.5 mol of water per 1 mol of amine. When water is added by more than 1 mol/1 mol amine, the ammonium bicarbonate compound is produced. This synthesis is performed under normal pressure or increased pressure without any specific solvent. If necessary, a solvent selected from the group consisting of water; alcohols such as methanol, ethanol, isopropanol and butanol; glycols such as ethyleneglycol and glycerin; acetates such as ethylacetate, butylacetate and carbitolacetate; ethers such as diethylether, tetrahydrofuran and dioxane; ketones such as methylethylketone and acetone; hydrocarbon solvents such as hexane and heptane; aromatic hydrocarbon solvents such as benzene and toluene; halogen-substituted solvents such as chloroform, methylenechloride and carbontetrachloride; and a mixed solvent thereof can be used. At this time, carbon dioxide can be used as bubbling in gas phase or solid dry ice. The carbon dioxide can be reacted under supercritical condition. In addition to the above method, any informed method can be used to prepare the ammonium carbamate, ammonium carbonate or ammonium bicarbonate derivatives as long as the final product has the same structure. That is, solvent, reaction temperature, concentration or catalyst is not limited and neither is yield.

Organic silver complex compound can be prepared by reacting the above ammonium carbamate, ammonium carbonate or ammonium bicarbonate compound with silver compound. For example, as shown in formula 1, at least one silver compound is directly reacted with the compounds represented by formula 2-4 or the mixture thereof in the presence of nitrogen under normal pressure or increased pressure without a solvent. If a solvent is used, the solvent can be selected from the group consisting of water; alcohols such as methanol, ethanol, isopropanol and butanol; glycols such as ethyleneglycol and glycerin; acetates such as ethylacetate, butylacetate and carbitolacetate; ethers such as diethylether, tetrahydrofuran and dioxane; ketones such as methylethylketone and acetone; hydrocarbon solvents such as hexane and heptane; aromatic hydrocarbon solvents such as benzene and toluene; halogen-substituted solvents such as chloroform, methylenechloride and carbontetrachloride; and a mixed solvent thereof.

The method for manufacturing the silver complex compound of the present invention is described in Korean Patent Application No. 10-2006-0011083 applied by the present inventors, in which the silver complex compound can be separated as a solid from the solution and the separated solid is either the complex composed of silver ions ($Ag^+$) and anions ($X^{n-}$) and carbamate or carbonate based compound of formulas 2-4 or the complex having the following structure of empirical formula resulted from the reduction of some silver ions in the complex.

$$Ag[A]_m \qquad \text{[Empirical Formula]}$$

[A is the compound of formula 2-formula 4 and m is 0.7-2.5.]

The coating solution used in step (i) of the method of the present invention includes the above silver complex compound or its mixture, and if necessary, a conventional solvent, a stabilizer and a surfactant can be additionally included.

The solvent included in the coating solution can be selected from the group consisting of water, alcohol, glycol, acetate, ether, ketone, aliphatic hydrocarbon, aromatic hydrocarbon and halogenated hydrocarbon solvents. Particularly the solvent can be one or more compounds selected from the group consisting of water, methanol, ethanol, isopropanol, 1-methoxypropanol, butanol, ethylhexyl alcohol, terpineol, ethyleneglycol, glycerin, ethylacetate, butylacetate, methoxypropylacetate, carbitolacetate, ethylcarbitolacetate, methylcellosolve, butylcellosolve, diethylether, tetrahydrofuran, dioxane, methylethylketone, aceton, dimethylformamide, 1-methyl-2-pyrrolidone, dimethylsulfoxide, hexane, heptane, dodecane, paraffin oil, mineral spirit, benzene, toluene, xylene, chloroform, methylenechloride, carbontetrachloride and acetonitrile.

The surfactant herein is used for even and fine coating on the fiber surface, which can be selected from the group consisting of alkylene amines such as triethyleneglycoldiamine, polyoxypropylenediamine, polyoxymethyl-1,2-ethanediyl, hydro-2-amino-methyl-ethoxy-ether, 2-ethylhydroxymethyl-1,3-propanediol; and non-ionic surfactants such as octylphenolethoxylate, nonylphenolethoxylate and ethyleneoxide/propyleneoxide copolymer.

The stabilizer herein can be selected from the group consisting of the first, the second or the third amine compounds with or without hydroxyl group; ammonium compounds selected from ammonium carbamate based, ammonium carbonate based or ammonium bicarbonate based compounds; phosphorous compounds selected from phosphine, phosphite or phosphate compounds; sulfur compounds selected from thiol or sulfide compounds; and a mixture thereof. Particularly, the amine compound is exemplified by methylamine, ethylamine, n-propylamine, isopropylamine, n-butylamine, isobutylamine, isoamylamine, n-hexylamine, 2-ethylhexylamine, n-heptylamine, n-octylamine, isooctylamine, nonylamine, decylamine, dodecylamine, hexadecylamine, octadecylamine, docodecylamine, cyclopropylamine, cyclopentylamine, cyclohexylamine, allylamine, hydroxyamine, ammoniumhydroxide, methoxyamine, 2-ethanolamine, methoxyethylamine, 2-hydroxy propylamine, 2-hydroxy-2-methylpropylamine, methoxypropylamine, cyanoethylamine, ethoxyamine, n-butoxyamine, 2-hexyloxyamine, methoxyethoxyethylamine, methoxyethoxyethoxyethylamine, diethylamine, dipropylamine, diethanolamine, hexamethyleneimine, morpholine, piperidine, piperazine, ethylenediamine, propylenediamine, hexamethylenediamine, triethylenediamine, 2,2-(ethylenedioxy)bisethylamine, triethylamine, triethanolamine, pyrrole, imidazole, pyridine, aminoacetaldehyde dimethyl acetal, 3-aminopropyltrimethoxysilane, 3-aminopropyltriethoxysilane, aniline, anisidine, aminobenzonitrile, benzylamine and derivatives thereof, polymer compounds such as polyallylamine or polyethyleneimine and derivatives thereof.

The ammonium carbamate based compound is exemplified by ammonium carbamate, ethylammonium ethylcarbamate, isopropylammonium isopropylcarbamate, n-butylammonium n-butylcarbamate, isobutylammonium isobutylcarbamate, t-butylammonium t-butylcarbamate, 2-ethylhexylammonium 2-ethylhexylcarbamate, octadecylammonium octadecylcarbamate, 2-methoxyethylammonium 2-methoxyethylcarbamate, 2-cyanoethylammonium 2-cyanoethylcarbamate, dibutylammonium dibutylcarbamate, dioctadecylammonium dioctadecylcarbamate, methyldecylammonium methyldecylcarbamate, hexamethyleneimineammonium hexamethyleneiminecarbamate, morpholinium morpholinecarbamate, pyridinium ethylhexylcarbamate, triethylenediaminium isopropylbicarbamate, benzylammonium benzylcarbamate, triethoxysilylpropylammonium triethoxysilylpropylcarbamate and derivatives thereof. The ammonium carbonate based compound is exemplified by ammonium carbonate, ethylammonium ethylcarbonate, isopropylammonium isopropylcarbonate, n-butylammonium n-butylcarbonate, isobutylammonium isobutylcarbonate, t-butylammoniumt-butylcarbonate, 2-ethylhexylammonium 2-ethylhexylcarbonate, 2-methoxyethylammonium 2-methoxyethylcarbonate, 2-cyanoethylammonium 2-cyanoethylcarbonate, octadecylammonium octadecylcarbonate, dibutylammonium dibutylcarbonate, dioctadecylammonium dioctadecylcarbonate, methyldecylammonium methyldecylcarbonate, hexamethyleneimineammonium hexamethyleneiminecarbonate, morpholineammonium morpholinecarbonate, benzylammonium benzylcarbonate, triethoxysilylpropylammonium triethoxysilylpropylcarbonate, triethylenediamnium isopropylcarbonate and derivatives thereof. The ammonium bicarbonate based compound is exemplified by ammonium bicarbonate, isopropylammonium bicarbonate, t-butylammonium bicarbonate, 2-ethylhexylammonium bicarbonate, 2-methoxyethylammonium bicarbonate, 2-cyanoethylammonium bicarbonate, dioctadecylammonium bicarbonate, pyridinium bicarbonate, triethylenediaminum bicarbonate and derivatives thereof.

The phosphorous compound herein is the one represented by the general formula $R_3P$, $(RO)_3P$ or $(RO)_3P$0. Wherein, R is independently $C_1$-$C_{20}$ alkyl or aryl group, which is exemplified by tributylphosphine, triphenylphosphine, triethylphosphite, triphenylphosphite, dibenzylphosphate and triethylphosphate, etc. The sulfur compound is exemplified by butanethiol, n-hexanethiol, diethylsulfide, tetrahydrothiophene, allyldisulfide, mercaptobenzothiazole, alkylmercaptoacetate, tetrahydrothiophene and octylthioglycolate.

The content of the stabilizer is not limited as long as it meets the purpose of maintaining characteristics of the coating solution composition of step (i). However, the preferable molar ratio of the stabilizer to the silver compound of formula 1 is 0.1%~90% and 1%~50% is more preferred. If the content of the stabilizer is over the above range, conductivity will be reduced. On the other hand, if the content of the stabilizer is less than the above range, stability will be reduced.

The method for coating a strand or a bundle of fiber with the silver complex compound coating solution can be any of dip coating, spray coating, flow coating, slide coating and roll to roll coating, but mechanical strength and conductivity should not be damaged after the coating.

Step (ii):

In step (ii), the fibers coated with silver complex compound in step (i) are heat-treated to give fibers coated with silver. Herein, the heat-treatment can be performed under inert atmosphere or if necessary, in the presence of air, nitrogen, or carbon dioxide, or in the presence of a mixed gas comprising hydrogen and air or other inert gas. The heat treatment is performed at 80~400° C., preferably at 90~300° C. and more preferably at 100~250° C. In addition, two-step or multi-step heat treatment, that is low temperature treatment and high temperature treatment take turns, can be performed and in fact this multi-step heat treatment favors even coating of the silver complex compound. For example, the heat-treatment is performed at 80~150° C. for 1~30 minutes, followed by another heat-treatment at 150~300° C. for 1~30 minutes.

After the heat-treatment, the fibers coated with a silver coating layer can be further coated with metals such as copper, nickel and gold via electro-plating or electroless plating to form an additional metal coating layer thereon.

Step (iii):

In step (iii), an antioxidant layer is formed on the silver coating layer coated on fibers.

This antioxidant layer is to increase conductivity by preventing oxidation of the silver coating layer. Antioxidant coating solution containing one or more compounds selected from the group consisting of sulfur compounds such as ethyleneglycoldimercaptoacetate, mercaptoethanol, mercaptopropanol, phenyltriazolethiol, ethylsulfide, butylsulfide and mercaptopropyltriethoxysilane is coated on the fibers having silver coating layer, followed by drying. The content of the sulfur compound or a mixture thereof in the antioxidant coating solution is 0.1-10 weight %.

The method for coating the antioxidant coating solution is selected from the group consisting of dip coating, spray coating, flow coating and slide coating, and any conventional method can be used as long as smoothness of the surface and conductivity are not damaged by that after coating. For drying process, drying temperature or time does not matter but generally drying is performed at 60~120° C. for 1~30 minutes.

FIG. 1 is a schematic diagram illustrating the manufacturing device according to the method of manufacturing conductive fibers described in a preferred embodiment of the present invention. However, this schematic diagram of the manufacturing device shown in FIG. 1 is only an example of the present invention and cannot limit the spirit and scope of the present invention.

As shown in FIG. 1, fiber spinning solution is transferred to high temperature furnace (103) through transfer tube (102) from raw material tank (101) and then passed through bushing (104) containing thousands of orifices, and then cooled down with air to form fiber strands (105). Thousands of the fiber strands (105) generated thereby proceed to conductive sizing vessel (106) filled with coating solution comprising silver complex compound or a mixture thereof, resulting in plaiting to give fibers coated with silver complex compound. The fiber bundle (107) coated with silver complex compound is transferred to a drier (108*a*), followed by heat-treatment to give conductive fiber bundle coated with silver complex. In the meantime, the conductive fibers tied in a bundle proceed to antioxidant coating vessel (109) filled with antioxidant solution, leading to coating with the antioxidant solution, which then transferred to a drier (108*b*). After dried, conductive fibers coated with antioxidant layer are prepared.

In addition, after heat-treating in the drier (108*a*), the conductive fibers coated with silver complex can be further coated with metals such as copper, nickel and gold by electroplating or electroless plating.

As explained hereinbefore, the prepared conductive fibers are cut into a certain length, which are mixed with fiber spinning solution, followed by melt spinning or solution spinning to give conductive fibers. When the conductive fibers are cut into a certain length, the fiber bundle turns into thousands of fiber strands and at this time, the ratio of diameter to length of the strand is preferably 100-1000.

DESCRIPTION OF DRAWINGS

The above and other objects, features and advantages of the present invention will become apparent from the following description of preferred embodiments given in conjunction with the accompanying drawings, in which: FIG. 1 is a schematic diagram illustrating the manufacturing process according to the method of manufacturing conductive fibers described in a preferred embodiment of the present invention.

<Explanation Of Reference Numerals For Designating Main Components In The Drawings>

| | |
|---|---|
| 101: raw material tank | 102: transfer tube |
| 103: furnace | 104: bushing |
| 105: fiber strands | 106: conductive sizing vessel |
| 107: fiber bundle | 108a, 108b: drier |

109: antioxidant coating vessel 110: rewind roll

BEST MODE

Practical and presently preferred embodiments of the present invention are illustrative as shown in the following Examples.

However, it will be appreciated that those skilled in the art, on consideration of this disclosure, may make modifications and improvements within the spirit and scope of the present invention.

EXAMPLE 1

2.1 kg (6.94 mol) of 2-ethylhexylammonium 2-ethylhexylcarbamate and 0.825 kg (5.08 mol) of isobutylammonium isobutylcarbamate were dissolved in 5.2 kg of isopropanol in a reactor equipped with stirrer, to which 1 kg (4.31 mol) of silver oxide was added, followed by reaction at room temperature. The reaction solution was at first the black slurry but as reaction went on, which meant the complex compound began to be generated, the reaction solution turned into light color or colorless. After two hours of the reaction, colorless transparent solution was obtained. 0.125 kg of 2-hydroxy-2-methylpropylamine was added to the obtained solution as a stabilizer, followed by stirring. The solution was then filtered with 0.45 an membrane filter, followed by TGA (Thermogravimetry Analysis). As a result, conductive coating solution containing silver by 10.05 weight % was prepared. The prepared coating solution was loaded in a tank where acryl fibers (Taekwang Industrial Co., K8) were dipped for 3 minutes, which was transferred to a drier, followed by firing at 150° C. for 3 minutes to give fibers coated with silver. The prepared conductive acryl fibers were dipped into antioxidant coating solution comprising 0.01 kg of ethyleneglycoldimercaptoacetate, 0.002 kg of Surfynol 104 (Air Products), 0.688 kg of ethanol and 0.4 kg of water, for 2 minutes, which was dried in an 80° C. drier to give conductive fibers having the conductivity of 0.5 Ω-cm.

EXAMPLE 2

3.26 kg (10.8 mol) of 2-ethylhexylammonium 2-ethylhexylcarbamate was dissolved in 4.93 kg of heptane in a reactor equipped with stirrer, to which 1 kg (4.31 mol) of silver oxide was added, followed by reaction at room temperature for 2 hours. 0.13 kg of 1-amino-2-propanol was added thereto as a stabilizer, followed by TGA. As a result, conductive coating solution containing silver by 9.98 weight % was prepared. The prepared coating solution was loaded in a tank where nylon fibers (Toray, Linart) were dipped for 3 minutes, which was transferred to a drier, followed by firing at 150° C. for 3 minutes to give fibers coated with silver. The prepared conductive nylon fibers were dipped into antioxidant coating solution comprising 0.05 kg of mercaptoethane, 0.002 kg of Surfynol 104 (Air Products), 0.685 kg of isopropanol and 0.3 kg of water, for 2 minutes, which was dried in an 80° C. drier to give conductive fibers having the conductivity of 1.2 Ω-cm.

EXAMPLE 3

2.04 kg (10.75 mol) of iso-butylammonium iso-butylcarbamate was dissolved in 4.76 kg of ethanol in a reactor equipped with stirrer, to which 1 kg (4.31 mol) of silver oxide was added, followed by reaction at room temperature. 0.15 kg of 1-aminomethyl-2-propanol was added thereto, followed by TGA. As a result, conductive coating solution containing silver by 11.7 weight % was prepared. The prepared coating solution was loaded in a tank where glass fibers (Owenscorning, SE1200) were dipped for 3 minutes, which was transferred to a drier, followed by firing at 150° C. for 3 minutes to give fibers coated with silver. The prepared conductive glass fibers were dipped into antioxidant coating solution comprising 0.05 kg of mercaptoethane, 0.002 kg of EFKA3772 (Efka), 0.685 kg of isopropanol and 0.3 kg of water, for 2 minutes, which was dried in an 80° C. drier to give conductive fibers having the conductivity of 1.5Ω-cm.

EXAMPLE 4

3.25 kg (10.74 mol) of 2-ethylhexylammonium 2-ethylhexylcarbamate was dissolved in 5.75 kg of isopropanol in a reactor equipped with stirrer, to which 1 kg (4.31 mol) of silver oxide was added, followed by reaction at room temperature. The reaction solution was at first the black slurry but as reaction went on, which meant the complex compound began to be generated, the reaction solution turned into light color or colorless. After two hours of the reaction, colorless transparent solution was obtained. 0.75 kg of EM-517 (nonionic bisphenol A noblock resin emulsion, Asahi Denka) was added to the obtained solution, followed by stirring for one hour to give conductive sizing coating solution containing silver by 8.65 weight %. The glass fiber strands spun and cooled by passing through the bushing in the apparatus as shown in FIG. 1 are applied with the conductive sizing coating solution and plaited, and then dried at 150° C. for 10 minutes to give a fiber bundle of 1.2 mm in diameter. The prepared conductive fiber bundle was dipped into antioxidant coating solution comprising 0.01 kg of ethyleneglycoldimercaptoacetate, 0.002 kg of Surfynol 104 (Air Products), 0.688 kg of ethanol and 0.3 kg of water, for 2 minutes, which was dried in an 80° C. drier to give conductive fibers having the conductivity of 10Ω-cm.

EXAMPLE 5

The nylon fiber (Linart, Toray) bundle spun by the conventional bushing and treated with a sizing agent was unwoven into strands again, which were dipped in the tank filled with the silver coating solution of Example 4 for 3 minutes, followed by plaiting and firing in an 150° C. drier for 3 minutes, resulting in the fiber bundle coated with silver. The prepared conductive fiber bundle was dipped into antioxidant coating solution comprising 0.01 kg of ethyleneglycoldimercaptoacetate, 0.002 kg of Surfynol 104 (Air Products), 0.688 kg of isopropanol and 0.3 kg of water, for 2 minutes, which was dried in an 80° C. drier to give conductive fibers having the conductivity of 1.2Ω-cm.

EXAMPLE 6

The acryl fiber (K8, Taekwang Industrial Co.) bundle spun by the conventional bushing and treated with a sizing agent was unwoven into strands again, which were mixed with 0.093 kg of YD-115J (BGE modified low viscosity epoxy resin, Kukdo Chemical Co.) as the adhesion enhancer, and the silver coating solution of Example 4, followed by stirring. The prepared silver coating solution was loaded in a tank where the fiber strands were dipped for 3 minutes. Then, the fiber strands were dried in a drier, plaited, and fired at 150° C. for 3 minutes to give the fiber bundle coated with silver. The prepared conductive acryl fiber bundle was dipped into antioxidant coating solution comprising 0.05 kg of mercaptoethane, 0.002 kg of Surfynol 104 (Air Products) and 0.685 kg of ethanol, for 2 minutes, which was dried in an 80° C. drier to give conductive fibers having the conductivity of 1.8Ω-cm.

EXAMPLE 7

The glass fiber (SE1200, Owenscorning) bundle spun by the conventional bushing and treated with a sizing agent was unwoven into strands again, which were dipped in the tank containing POLYDO 120 (polyurethane resin primer, Kukdo Chemical Co.) for 5 minutes and then transferred to a drier, followed by curing at 150° C. for 5 minutes. The fiber strands coated with polyurethane resin were dipped in another tank containing the silver coating solution prepared in Example 4 for 3 minutes. Then, the fiber strands were dried in a drier, plaited, and fired at 150° C. for 3 minutes to give the glass fiber bundle coated with silver. The prepared conductive glass fiber bundle was dipped into antioxidant coating solution comprising 0.05 kg of mercaptoethane, 0.002 kg of EFKA3772 (Efka) and 0.685 kg of isopropanol, for 2 minutes, which was dried in an 80° C. drier to give conductive glass fibers having the conductivity of 1.92Ω-cm.

EXAMPLE 8

0.3 kg of the conductive glass fiber bundle before antioxidant coating in Example 4, cut by a cutter into 3 mm fragments, was mixed with 1.0 kg of Sefton2002 (styrene-isoprene copolymer, Kuraray), to which 5.0 kg of toluene was added, and then uniformly distributed spinning solution was prepared by ball mill. The prepared spinning solution was filtered to eliminate non-dispersed materials, followed by removing bubbles for 30 minutes using deaeration apparatus, dry-spinning, and drying at 80° C. for 15 hours to give conductive fibers. The prepared conductive fibers were dipped into antioxidant coating solution comprising 0.05 kg of mercaptoethane, 0.002 kg of Surfynol 104 (Air Products), 0.685 kg of isopropanol and 0.3 kg of water, for 2 minutes, which was dried in an 80° C. drier to give conductive fibers having the conductivity of 1.5 kohm-cm.

EXAMPLE 9

0.1 kg of the conductive glass fiber bundle before antioxidant coating in Example 4, cut by a cutter into 3 mm fragments, was mixed with 0.5 kg of kraton-support 1650 (styrene-butylene-styrene block copolymer, Shell), to which 6.0 kg of toluene was added, and then uniformly distributed spinning solution was prepared by ball mill. The prepared spinning solution was filtered to eliminate non-dispersed materials, followed by removing bubbles for 30 minutes using deaeration apparatus, dry-spinning, and drying at 80° C. for 12 hours to give conductive fibers. The prepared conductive fibers were dipped into antioxidant coating solution comprising 0.01 kg of ethyleneglycoldimercaptoacetate, 0.002 kg of Surfynol 104 (Air Products), 0.688 kg of ethanol and 0.3 kg of water, for 2 minutes, which was dried in an 80° C. drier to give conductive fibers having the conductivity of 1.21 kΩ-cm.

EXAMPLE 10

The conductive glass fibers before antioxidant coating in Example 4 were soaked in 1 kg of catalyst aqueous solution comprising 0.5 g of palladium chloride and 2 g of hydrochloric acid, for 5 minutes to be activated. After washing, nickel plating was performed via electroless plating by soaking the fibers in 1 kg of plating solution comprising 50 g of nickel sulfate and 20 g of nickel chloride for 10 minutes. As a result, conductive fibers having the plating layer of 0.5 μm in thickness and the conductivity of 0.3Ω-cm were prepared.

[Industrial Applicability]

The present invention provides a method of manufacturing conductive fibers having excellent conductivity and mechanical properties which favors economical production with low production costs.

The present invention also provides a method of manufacturing conductive fibers that gives excellent conductivity and sizing effect because according to this method silver complex compound coating solution is coated which is followed by heat-treatment, so that very fine silver particles are coated on the surface of fiber with making the surface smooth and giving conductivity.

In addition, the conductive fibers prepared by the method of the present invention can be applied to electromagnetic wave shields, filters and antimicrobial fibers owing to the silver coating layer formed thereon.

The invention claimed is:

1. A method of manufacturing conductive fibers, which comprises the following steps:

(i) preparing fibers coated with a silver complex compound, which is prepared by reacting silver compound represented by formula 1, and one or more compounds selected from ammonium carbamate based compound represented by formula 2, ammonium carbonate based compound represented by formula 3 and ammonium bicarbonate based compound represented by formula 4 and the mixture thereof, by coating the silver complex compound coating solution on a strand or a bundle of fiber;

(ii) preparing fibers having a silver coating layer by heating the silver complex compound coated fibers; and (iii) forming an anti-oxidant layer on the silver coating layer:

[Formula 1]

$Ag_nX$

[Formula 2]

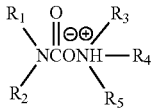

[Formula 3]

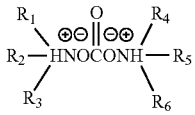

[Formula 4]

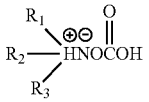

wherein,

X is a substituent selected from the group consisting of oxygen, sulfur, halogen, cyano, cyanate, carbonate, nitrate, nitrite, sulfate, phosphate, thiocyanate, chlorate, perchlorate, tetrafluoroborate, acetylacetonate, carboxylate and their derivatives, n is an integer of 1-4, $R_1$-$R_6$ are independently H, hydroxyl group, $C_1$-$C_{30}$ alkoxy group, $C_1$-$C_{30}$ aliphatic or cycloaliphatic alkyl group or $C_6$-$C_{20}$ aryl or aralkyl group, functional group-substituted $C_1$-$C_{30}$ alkyl and aryl group, heterocyclic compound and polymer and their derivatives, wherein at least one of $R_1$-$R_6$ is independently selected from methyl, ethyl, propyl, isopropil, butyl, isobutyl amyl, hexyl, ethylhexyl, heptyl, octyl, isooctyl, nonyl, decyl, dodecyl, hexadecyl, octadecyl, docodecyl, cyclopropyl, cyclopentyl, cyclohexyl, allyl, hydroxy, methoxy, methoxyethyl, methoxypropyl, cyanoethyl, ethoxy, butoxy, hexyloxy, methoxyethoxyethyl, methoxyethoxyethoxyethyl, hexamethyleneimine, morpholine, piperidine, piperazine, ethylenediamine, propylenediamine, hexamethylenediamine, triethylenediamine, pyrrole, imidazole, pyridine, carboxymethyl, trimethoxysilylpropyl, triethoxysilylpropyl, phenyl, methoxyphenyl, cyanophenyl, phenoxy, tolyl, benzyl, polyallylamine, polyethyleneamine and a derivative thereof.

2. The method of manufacturing conductive fibers according to claim 1, wherein a step of forming a metal coating layer on the silver coating layer via electro-plating or electroless plating is additionally included after the step (ii).

3. The method of manufacturing conductive fibers according to claim 1, wherein the silver compound is one or more compounds selected from the group consisting of silver oxide, silver thiocyanate, silver sulfide, silver chloride, silver cyanide, silver cyanate, silver carbonate, silver nitrate, silver nitrite, silver sulfate, silver phosphate, silver perchlorate, silver tetrafluoroborate, silver acetylactonate, silver acetate, silver lactate, silver oxalate and derivatives thereof.

4. The method of manufacturing conductive fibers according to claim 1, wherein the $R_1$-$R_6$ are selected independently from the group consisting of hydrogen, methyl, ethyl, propyl, isopropyl, butyl, isobutyl, amyl, hexyl, ethylhexyl, heptyl, octyl, isooctyl, nonyl, decyl, dodecyl, hexadecyl, octadecyl, docodecyl, cyclopropyl, cyclopentyl, cyclohexyl, allyl, hydroxy, methoxy, hydroxyethyl, methoxyethyl, 2-hydroxy propyl, methoxypropyl, cyanoethyl, ethoxy, butoxy, hexyloxy, methoxyethoxyethyl, methoxyethoxyethoxyethyl, hexamethyleneimine, morpholine, piperidine, piperazine, ethylenediamine, propylenediamine, hexamethylenediamine, triethylenediamine, pyrrole, imidazole, pyridine, carboxymethyl, trimethoxysilylpropyl, triethoxysilylpropyl, phenyl, methoxyphenyl, cyanophenyl, phenoxy, tolyl, benzyl, polyallylamine, polyethyleneimine and derivatives thereof, wherein at least one of $R_1$-$R_6$ is independently selected from methyl, ethyl, propyl, isopropyl, butyl, isobutyl, amyl, hexyl, ethyihexyl, heptyl, octyl, isooctyl, nonyl, decyl, dodecyl, hexadecyl, octadecyl, docodecyl, cyclopropyl, cyclopentyl, cyclohexyl, allyl, hydroxy, methoxy, methoxyethyi, methoxypropyl, cyanoethyl, ethoxy, butoxy, hexyloxy, methoxyethoxyethyl, methoxyethoxyethoxyethyl, hexamethyleneimine, morpholine, piperidine, piperazine, ethylenediamine, propylenediamine, hexamethylenediamine, triethylenediamine, pyrrole, imidazole, pyridine, carboxymethyl, trimethoxysilylpropyl, triethoxysilylpropyl, phenyl, methoxyphenyl, cyanophenyl, phenoxy, tolyl, benzyl, polyallylamine, polvethyleneamine and a derivative thereof.

5. The method of manufacturing conductive fibers according to claim 1, wherein the ammonium carbamate based compound represented by formula 2 is one or more compounds selected from the group consisting of ethylammonium ethylcarbamate, isopropylammonium isopropylcarbamate, n-butylammonium n-butylcarbamate, isobutylammonium isobutylcarbamate, t-butylammonium t-butylcarbamate, 2-ethylhexylammonium 2-ethylhexylcarbamate, octadecylammonium octadecylcarbamate, 2-methoxyethylammonium 2-methoxyethylcarbamate, 2-cyanoethylammonium 2-cyanoethylcarbamate, dibutylammonium dibutylcarbamate, dioctadecylammonium dioctadecylcarbamate, methyldecylammonium methyldecylcarbamate, hexamethyleneimineammonium hexamethyleneiminecarbamate, morpholinium morpholinecarbamate, pyridinium ethylhexylcarbamate, triethylenediaminum isopropylbicarbamate, benzylammonium benzylcarbamate, triethoxysilylpropylammonium triethoxysilylpropylcarbamate and derivatives thereof;

the ammonium carbonate based compound represented by formula 3 is one or more compounds selected from the group consisting of ethylammonium ethylcarbonate, isopropylammonium isopropylcarbonate, n-butylammonium n-butylcarbonate, isobutylammonium isobutylcarbonate, t-butylammonium t-butylcarbonate, 2-ethylhexylammonium 2-ethylhexylcarbonate, 2-methoxyethylammonium 2-methoxyethylcarbonate, 2-cyanoethylammonium 2-cyanoethylcarbonate, octadecylammonium octadecylcarbonate, dibutylammonium dibutylcarbonate, dioctadecylammonium dioctadecylcarbonate, methyldecylammonium methyldecylcarbonate, hexamethyleneimineammonium hexamethyleneiminecarbonate, morpholineammonium morpholinecarbonate, benzylammonium benzylcarbonate, triethoxysilylpropylammonium triethoxysilylpropylcarbonate, triethylenediaminum isopropylcarbonate and derivatives thereof; and the ammonium bicarbonate based compound represented by formula 4 is one or more compounds selected from the group consisting of isopropylammonium bicarbonate, t-butylammonium bicarbonate, 2-ethylhexylammonium bicarbonate, 2-methoxyethylammonium bicarbonate, 2-cyanoethylammonium bicarbonate, dioctadecylammonium bicarbonate, pyridinium bicarbonate, triethylenediaminum bicarbonate and derivatives thereof.

6. The method of manufacturing conductive fibers according to claim 1, wherein the coating solution additionally includes one or more additives selected from the group consisting of solvent, stabilizer, and surfactant.

7. The method of manufacturing conductive fibers according to claim 6, wherein the stabilizer is selected from the group consisting of first, second or third amine compounds with or without hydroxyl group; ammonium compounds selected from ammonium carbamate based, ammonium carbonate based or ammonium bicarbonate based compounds; phosphorous compounds selected from phosphine, phosphite or phosphate compounds; sulfur compounds selected from thiol or sulfide compounds; and a mixture thereof.

8. The method of manufacturing conductive fibers according to claim 6, wherein the surfactant is one or more compounds selected from the group consisting of triethyleneglycoldiamine, polyoxypropylenediamine, polyoxymethyl-1,2-ethanediyl, hydro-2-amino-methyl-ethoxy-ether, 2-ethylhydroxymethyl-1,3-propanediol, octylphenolethoxylate, nonylphenolethoxylate and ethyleneoxide/propyleneoxide copolymer.

9. The method of manufacturing conductive fibers according to claim 1, wherein the coating is performed by dip coating, spray coating, flow coating, slide coating or roll to roll coating.

10. The method of manufacturing conductive fibers according to claim 1, wherein a sizing agent is coated before or after coating with the silver complex compound coating solution.

11. The method of manufacturing conductive fibers according to claim 1, wherein the silver complex compound coating solution and a sizing agent are coated simultaneously.

12. The method of manufacturing conductive fibers according to claim 1, wherein the silver complex compound coating solution additionally contains a binder resin, an adhesion enhancer or a mixture thereof.

13. The method of manufacturing conductive fibers according to claim 12, wherein the binder resin is selected from the group consisting of phenol modified alkyd resin, epoxy modified alkyd resin, vinyl modified alkyd resin, silicon modified alkyd resin, acryl melamine resin, polyisocyanate resin, acryl urethane resin, urea resin, melamine resin, guanamine resin, amino alkyd resin, epoxy resin, epoxy ester resin, unsaturated polyester resin and a mixture thereof.

14. The method of manufacturing conductive fibers according to claim 12, wherein the adhesion enhancer is selected from the group consisting of triethoxysilane, 3-aminopropyltrimethoxyilane, 3-aminopropylethoxysilane, vinyltrimethoxysilane, vinyltriethoxysilane and a mixture thereof.

15. The method of manufacturing conductive fibers according to claim 1, wherein the fiber strands are prepared by unweaving a non-conductive fiber bundle.

16. The method of manufacturing conductive fibers according to claim 1, wherein the steps of coating fibers with a binder resin, an adhesion enhancer or the mixture thereof and drying the fibers are additionally included before coating the silver complex compound coating solution.

17. The method of manufacturing conductive fibers according to claim 1, wherein the antioxidant layer is formed by coating the antioxidant coating solution comprising one or more compounds selected from the group consisting of ethyleneglycoldimercaptoacetate, mercaptoethanol, mercaptopropanol, phenyltriazolethiol, ethylsulfide, butylsulfide and mercaptopropyltriethoxysilane and drying thereof.

* * * * *